United States Patent [19]

Nebeker et al.

[11] 4,142,972

[45] Mar. 6, 1979

[54] MECHANISM AND METHOD FOR RECOVERING MATERIAL FROM THE SURFACE OF A LIQUID BODY

[75] Inventors: Eugene B. Nebeker, Los Angeles; Sergio E. Rodriguez, Woodland Hills; Paul G. Mikoalj, Santa Barbara, all of Calif.

[73] Assignee: Scientific Associates, Inc., Santa Monica, Calif.

[21] Appl. No.: 793,280

[22] Filed: May 3, 1977

Related U.S. Application Data

[63] Continuation of Ser. No. 562,488, Mar. 27, 1975, abandoned, which is a continuation of Ser. No. 395,521, Sep. 10, 1973, abandoned, which is a continuation-in-part of Ser. No. 205,923, Dec. 8, 1971, abandoned.

[51] Int. Cl.[2] ..... E02B 15/04

[52] U.S. Cl. ..... 210/84; 210/242 S; 210/DIG. 25

[58] Field of Search ..... 210/65, 83, 84, 170, 210/208, 219, 242 S, 304, 512, DIG. 25

[56] References Cited

U.S. PATENT DOCUMENTS

| | | | |
|---|---|---|---|
| 3,635,342 | 1/1972 | Mourlon et al. | 210/84 |
| 3,810,546 | 5/1974 | Oxenham | 210/242 S |

OTHER PUBLICATIONS

Mikolaj et al. "Free Vortex Recovery of Floating Oil", Coast Guard Report No. 714103/A/003, Sep. 1970.

Nebeker et al. "Free Vortex Recovery of Floating Oil", paper presented at Prevention and Control of Oil Spills Conference, Washington, D.C., Jun. 15-17, 1971.

*Primary Examiner*—Thomas G. Wyse
*Assistant Examiner*—Ivars Cintins
*Attorney, Agent, or Firm*—Donald D. Mon

[57] ABSTRACT

Material such as an oil slick floating on a body of liquid, ordinarily water, is collected by a mechanism comprising an impeller beneath the liquid surface and a rotatable tubular element which together form a free vortex as the surface of the body of liquid that draws the material into a vortex pocket from which it can be pumped.

19 Claims, 10 Drawing Figures

EUGENE B. NEBEKER,
SERGIO E. RODRIGUEZ,
PAUL G. MIKOLAJ
INVENTORS.

BY
Angus & Mon
ATTORNEYS.

EUGENE B. NEBEKER,
SERGIO E. RODRIGUEZ,
PAUL G. MIKOLAJ
INVENTORS.

BY
Angus & Mann
ATTORNEYS.

MECHANISM AND METHOD FOR RECOVERING MATERIAL FROM THE SURFACE OF A LIQUID BODY

CROSS-REFERENCE TO OTHER PATENT APPLICATIONS

This is a continuation of patent application, Ser. No. 562,488, filed Mar. 27, 1975, which is abandoned. This is in turn a continuation of our patent application Ser. No. 395,521, filed Sept. 10, 1973, which in turn is a continuation-in-part of Ser. No. 205,923, filed Dec. 8, 1971, both of which are now abandoned.

Some portions of the invention herein described were made in the course of or under a contract with the United States Coast Guard, Contract No. DOT-CT-22878-A.

This invention relates to the recovery of material floating on the surface of a liquid body, such as oil spills floating on a sea or water-way.

An oil spill ordinarily spreads out on the surface of water forming a film on the surface of the order of a quarter of an inch or less in thickness. Such films pose obvious difficulties in their recovery from the water.

The desirability of recovering oil slicks at sea has been recognized. But there has heretofore not been known any skimming device which is effective under open ocean conditions, and there have heretofore been no known means for efficiently removing a thin film of oil from a water surface in anything but relatively calm water. There has not heretofore been a device capable of drawing in oil from large distances.

Mourlon, et al. U.S. Pat. No. 3,635,342 shows a system utilizing a vortex purporting to recover substance such as oil floating as a sheet on water. All of Mourlon's proposals embody the use of a captive vortex contained within the walls of a structure or container which is open at the top and placed very close to the surface of the water so that a vortex formed by rotation of an impeller within the container draws the vortex with the floating substance to be collected, down into the container from which it is extracted by a suitable suction pipe. Mourlon's hardware acts as a mechanical shield close to the water surface. Such arrangements can concentrate floating substance such as a sheet of oil on water under ideal surface conditions but cannot draw the floating substance into the vortex or concentrate substances which are not floating as a sheet. Such arrangements are not suitable for use in large open bodies of water where there are substantial waves, strong currents and winds because it has been found that hardware bobbing near the water surface restricts the surface inflow of an oil slick, making thin slicks difficult to recover efficiently, because it interferes with wave action, and may lead to the formation of oil-water emulsions due to the interaction of the hardware with the waves, and these emulsions are even more difficult to remove.

An object of this invention is to recover the floating material expeditiously and with a minimal admixture with the liquid of the liquid body.

A related object is to provide a recovery device which can readily be transported to a recovery site.

A further related object is to provide for the recovery of the floating material even under conditions of high seas, wind and currents, such as are commonly present at sea.

A further object is to attract material such as oil from substantial distances.

Another object is to provide a recovery system which is effective in a broad range of oil film thicknesses.

Still another object is to recover either or both of liquid oil and solid oil-sorbent materials.

The invention is carried out by creating at the surface of the liquid body a free vortex into which the floating material is drawn by inward surface currents, forming at the vortex a pocket of the material which can be recovered by conventional means. The free vortex both collects and separates an oil film from an ocean surface. The term "free vortex" as used herein means that the dimensions and position of the vortex are not defined by walls, nor does it culminate at an exit opening such as that of a bathtub. Instead the vortex exists freely within the liquid body.

It has been ascertained that there are two principal flow fields involved in a free vortex, namely, an axial flow field and a rotational flow field. The axial flow field may be generally defined as that flow which is in a generally axial direction, namely, downward from the surface. Such an axial flow field creates an inward radial flow along the water surface which tends to pull oil from appreciable distances into the area of the central pocket and thus sinks oil beneath the general water surface where it can be accumulated at the desired oil pocket. Furthermore, it provides a slight rotational motion in the very center at the point of convergence of the incoming surface radial flow, thereby creating a "bathtub" or axial-flow vortex which is typically long and slender.

The rotational flow field, on the other hand, transports oil to the center of the oil pocket due to the separating action of the centrifugal forces which tend to send the heavier water outward from the lighter oil, thereby maintaining the desired oil pocket at the center and providing needed stability for it. These actions of the rotational type flow assist in sinking oil below the water surface to form the oil pocket.

Neither the axial field alone nor the rotational field alone is the most desirable type of flow. Rotational flow alone tends to move water out from the center of rotation. At the surface, such action would tend to push an oil slick away from the vortex. In the case of a vortex formed in a small container this outward force is resisted by the container walls. However in the case of a free vortex there are no container walls creating this restraint.

If an axial-flow type vortex were used alone, as for example by use of an impeller alone, especially a rapidly rotating impeller without other cooperative means, the efficiency inherent in a free vortex would be reduced because it is a characteristic of the relatively long and slender axial flow vortex pull oil beneath the pocket into the impeller where it would mix with the water.

To maintain a pocket capable of holding and accumulating oil, a stable and wider pocket than that which can be formed by axial flow alone should usually be created, especially for use under conditions involving substantial wave motion, water currents and wind. This can be done by combining a rotational flow field with an axial flow field, so that the undesired outward radial flow due to rotation is balanced by the inward radial flow produced by the axial-type flow.

Better control of the vortex than obtainable with an impeller alone, especially in the presence of wave and water motion customarily experienced in the ocean, can be provided by use of a duct formed above the impeller. The duct may or may not rotate, as desired. Rotating the duct may tend to augment the rotational flow field to a desirable extent. Such a duct, whether rotatable or not, provides geometrical stabilization of the pocket.

An optional feature which improves the balance between the axial and radial flow paths resides in the attachment of a surface extending away from the axis of rotation such as an annular disc, to the outer edge of the rotating duct, so that the drag on the water of this horizontal surface augments that of the rotating duct.

A further optional feature found to assist the desired rotational flow involves the use of a stationary horizontal deflector at a position outside of and above the rotating disc. Such a deflector can be made flat and annular in shape and preferably with an inside diameter substantially equal to the outside diameter of the rotating disc. The deflector is preferably mounted on a stationary skirt surrounding the duct and disc.

It has been found that as impeller rotational speeds rise there is a tendensy for the vortex and oil pocket to become unstable. Such increased or high impeller speeds are obtainable however by use of a rotatable tubular element having an axis of rotation and an axial dimension of length, and including flow passage means permitting flow of liquid into and out of the rotatable tubular element entering and departing the rotatable tubular element from axially spaced-apart locations.

Suitable floats attached to the stationary frame of the device serve to hold the mechanism at an elevation below the surface of the body of water in which it floats favorable for the formation and maintenance of the vortex and pocket. In using the device, for example to recover an oil slick, the slick or a substantial portion of it will usually be captured within a suitable floating boom arrangement surrounding the slick, and the recovery mechanism according to this invention will be placed at a more or less central position within the boom. The oil pumped out from the suction tube whose lower end is inserted into the pocket can then be delivered to suitable containers.

The rotatable tubular element is substantially solid so that the vortex does not extend down through the rotatable tubular element. Instead, the downward flow into the impeller occurs primarily around the rotatable tubular element in the region between the rotator and the top of the duct. Suitable collecting means collects the floating substance such as oil, from the pocket in the vortex above the rotatable tubular element.

The foregoing and other features of the invention will be better understood from the following detailed description and the accompanying drawings of which:

Figure 1:
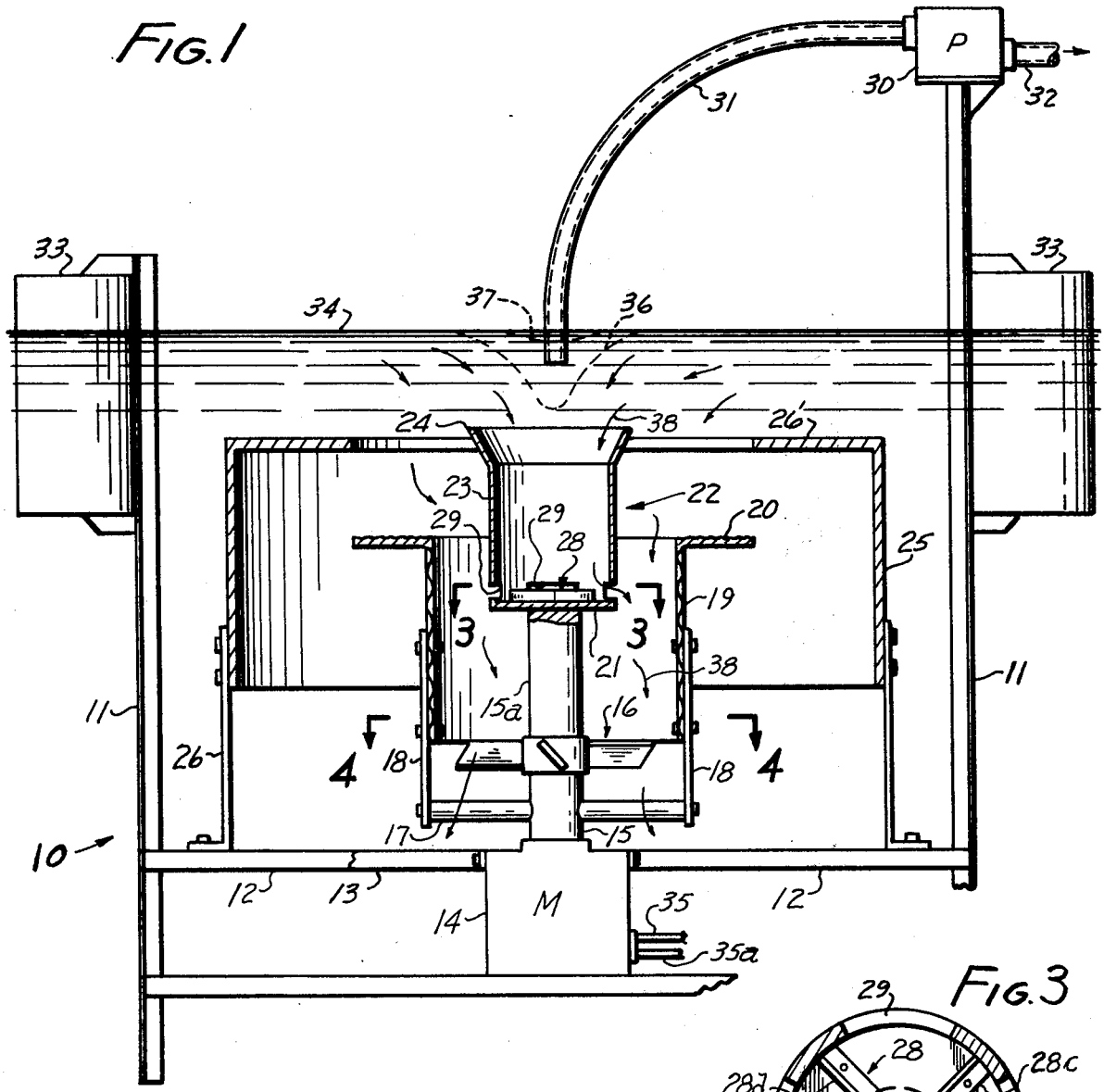
FIG. 1 is an elevation view, partly in section, of a mechanism according to this invention.
Figure 3:
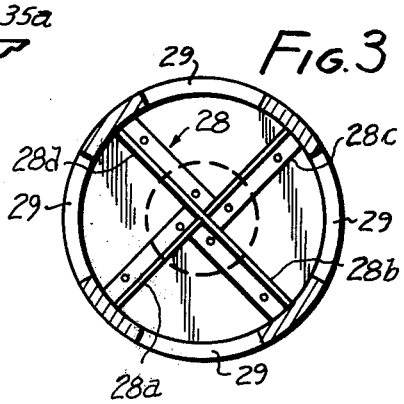
FIG. 3 is a cross-section view showing a detail taken at line 3—3 of FIG. 1.
Figure 4:
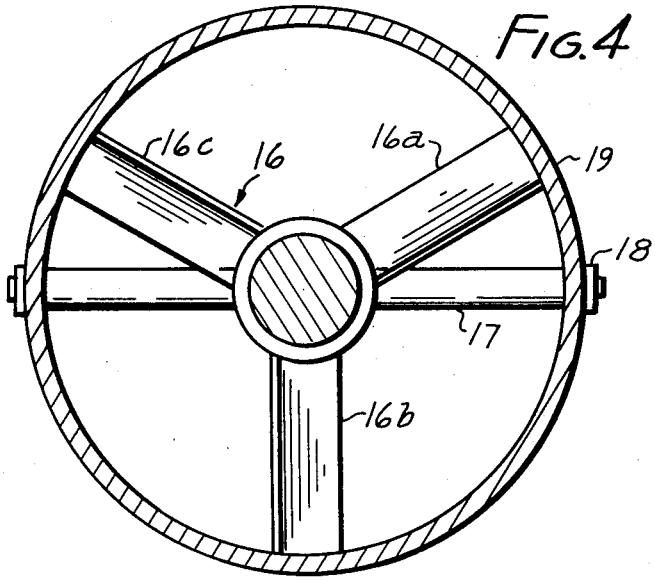
FIG. 4 is a cross-section view showing a detail taken at line 4—4 of FIG. 1.
Figure 2:
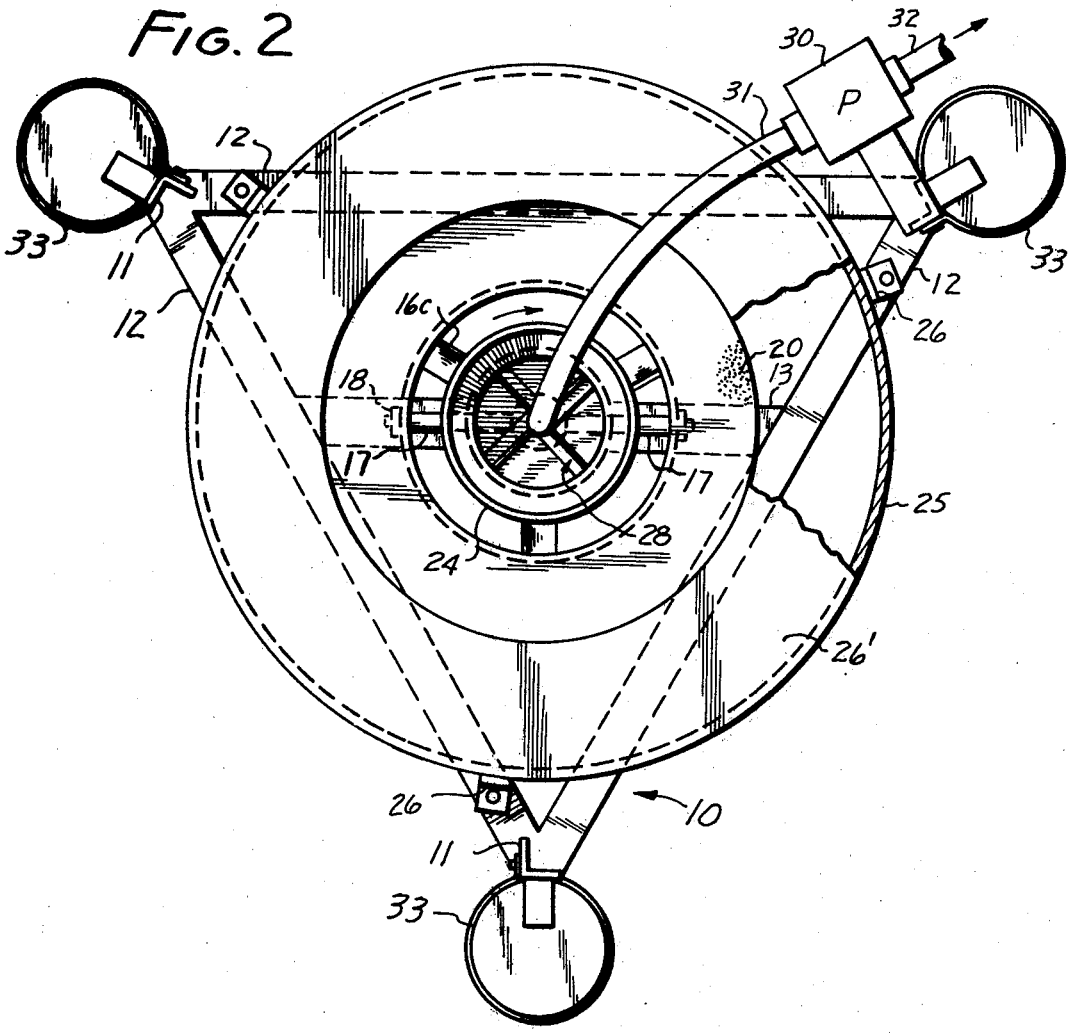
FIG. 2 is a top view of the mechanism of FIG. 1.

The mechanism shown in FIGS. 1 through 4 is mounted on a rigid frame work 10 comprising uprights 11 and horizontal members 12, which can conveniently be angle pieces. In this embodiment there are three such uprights joined by three horizontal members, all of substantially equal length, forming sides of a triangle. The central part of the triangle is traversed by a horizontal member 13 fastened at its ends to two of the horizontal members 12. A motor 14, preferably hydraulically operated, is supported at this central position on member 13 so that the axis of rotation of the motor extends vertically. The rotor of the motor has a hub 15 to which is attached an impeller 16 comprising three impeller blades 16*a*, 16*b* and 16*c* spaced at equal angles apart from each other. The pitch of the blades can conveniently be 45°, although a different pitch could be used. Also attached to the rotatable hub are arms 17, the outer extremities of which support respective uprights 18 to which is attached a duct 19 in the form of a corrugated cylinder somewhat of larger diameter than the impeller and co-axial with the axis of hub 15 and open at its upper and lower ends. The upper end of the duct 19 has attached to it an annular disc 20 the inner circumference of which is located at the circumference of the cylindrical duct and the outer circumference of which extends out beyond the circumference of the duct.

The hub 15 is provided with an extension 15*a* extending vertically upward from the impeller, which has attached to it the circular base 21 of a cylinder 22 having a cylindrical wall 23 coaxial with the hub and upstanding from its base and open at its upper end where it is formed into an outwardly flaring funnel 24. Cylinder 23 is sometimes called a "rotatable tubular member".

A cylindrical skirt 25 supported by uprights 26 attached to horizontal frame members 12, surrounds the disc 20 and is spaced from the outer periphery of this disc. The lower end of the skirt 25 is held at a position almost down to the lower edge of duct 19 and the skirt extends upward to a height which is about that of the funnel, where an annular disc-like deflector 26' extends inwardly from the skirt toward the funnel, but is spaced from the funnel.

A second impeller 28 attached to the upper side of base 21 comprises four blades 28*a*, 28*b*, 28*c* and 28*d* which can conveniently be made of angle pieces for easy attachment to the base, leaving a side of each angle piece extending vertically upward. These upstanding angle members extend radially 90° apart from each other. To provide for flow out the bottom of cylinder 22 the cylindrical wall 23 is provided with a number of openings in the form of slots 29 spaced apart from each other and located immediately above the base at positions between the ends of the blades of the second impeller 28.

One of the uprights 11 supports a pump 30, preferably hydraulically operated. A tube 31, preferably flexible, extends from the suction side of this pump to a position somewhat above the funnel and along the axis of the funnel, which is co-extensive with the axis of rotation of the motor 14 and main impeller 16. An outlet conduit 32 from pump 30 is led to a suitable receptacle (not shown) to convey material sucked up through tube 31.

Floats 33 attached at the same height to frame uprights 11 have a buoyancy such that when the device is placed in a liquid body such as a body of water, the liquid surface level 34 will be several inches above the top of the funnel 24, leaving the lower open end of tube 31 immersed in the liquid by a lesser number of inches. The pump will preferably be positioned above the liquid surface when the mechanism is thus floated.

To operate the mechanism, it is placed in the position shown in FIG. 1 in the liquid body the surface of which contains the material which it is desired to suck up through pump 30 for removal from the liquid. The floats will support the mechanism with the axis of rotation in the vertical position and with the lower end of tube 31 immersed, and all the mechanism below it submerged. The liquid body will ordinarily be water contaminated with a substance, for example an oil spill floating on its surface. It is a common practice to confine such a spill of oil or other undesirable material within floating booms which surround it so that the undesired contaminating material is confined to a relatively small area. The recovery mechanism will then be placed within such a boom arrangement and the motor 14 operated, for example, by forcing liquid to the motor through an entrance conduit 35 and out an exit 35*a*. This will rotate the impeller 16 together with duct 19 and receptacle 22, while the frame 10 together with skirt 25 remains substantially stationary due to the drag of these parts and the floats. The rotation of the main impeller 16 draws water down through it from the surface in the form of a vortex which extends downwardly from the surface. The water flowing through this cylinder is drawn out through openings 29 to a position within the surrounding duct 19 and down through the impeller 16 to mingle with the main body of water beneath the mechanism.

Since the contaminating substance such as oil is lighter than water it is drawn from the surface of the water radially inward toward the vortex, forming a pocket of this material in the region between the dotted lines 36 and 37. This is the region into which the lower end of conduit 31 dips. Hence, operation of pump 30 while motor 14 is in operation serves to suck up oil from this pocket, and as oil is removed from the oil pocket, more oil moves into the vortex from the surface to replenish the oil pocket.

The vortexing action is a desired combination of the axial and rotational types. The action of the main impeller 16 alone tends to accentuate the axial flow, while the rotating duct and its disc 20 tend to accentuate the rotational flow. The flow of the water is as indicated by arrows 38, part going downward through cylinder 22 and some going down between that cylinder and duct 19, the water rotating during this downward flow. In the flow down out of cylinder 22 the impeller 28 serves to facilitate the flow.

It has been observed that in the absence of the deflector 26' and skirt 25 there was sometimes experiences some undesirable up-welling of liquid at the region of the circumference of duct 19 when the duct with its annular disc 20 was rotated with the impeller, and that this up-welling created a tendency to push some oil upwardly, thereby not permitting the maximum efficiency obtainable. The presence of the stationary deflector 26' overcomes most of the upwelling. Any slight up-welling which would still occur even in the presence of the deflector is overcome by the presence of the stationary skirt 25.

This mechanism creates the desired stable vortex providing maintenance of the desired wide oil pocket from which oil can readily be extracted without undue mixture with water. The device can be made in a considerable range of sizes, for example by use of a main impeller of about one foot diameter up to a diameter of four feet or more. The dimensions of the equipment associated with the impeller will of course be predicated on the impeller diameter selected. Some suggested dimensions which have been found suitable for a smaller-sized device are as follows:

Impeller 16 hub—3 inches in diameter with three flat blade panels each 2 inches wide by $4\frac{1}{2}$ inches long and positioned at a pitch of 45°;

Placement on the top of the impeller blades—$23\frac{1}{2}$ below the water surface;

A duct 19 in the form of a corrugated cylinder nominally 14 inches inside diameter by 12 inches long, the bottom of the duct being placed even with the top of the impeller blades;

The annular disc 20—$14\frac{1}{2}$ inches inside diameter, and 23 inches outside diameter, preferably with its upper surface roughened to increase drag and located $11\frac{3}{4}$ inches below the water surface;

Annular deflector 26'—23 inches inside diameter and 38 inches outside diameter, with a 14 inches long vertical skirt 25 at its outer circumference, the lower surface of the deflector being 5 inches above the top of the disc 20, and the top face of the deflector, $6\frac{1}{4}$ inches below the water surface.

Slot openings 29 of the vertical stabilizer 22 set at 25% of its open area ($2\frac{1}{4}$ Sq. In. slot area), and the top of the stabilizer including the funnel—$5\frac{1}{2}$ inches below the water surface.

Oil recovery tubing—$\frac{3}{4}$ of an inch flexible copper tube with its lower end submerged to a depth of $3\frac{3}{4}$.

The recovery mechanism according to FIGS. 1 through 4 is useful under a wide range of sea and atmospheric conditions. It has been found that the vortex with its oil pocket can be formed and maintained even in very high seas and in the presence of strong water current flow and high winds. Such disturbances of course tend to produce some variable distortions of the vortex and pocket but without erasing them.

The type of vortex formed has been described herein as a free vortex to distinguish it from the type of totally restrained vortex formed in a small vessel such as a beaker. While it may be considered that some of the equipment of the recovery device such as the duct above the main impeller does apply a certain kind of restraint, such restraint is in the nature of maintenance of the vortex under adverse conditions, rather than a change of its character as a free vortex. Notwithstanding the presence of the parts of the equipment, the vortex maintains its essential character of a free vortex capable of maintaining an oil pocket.

Figure 5:
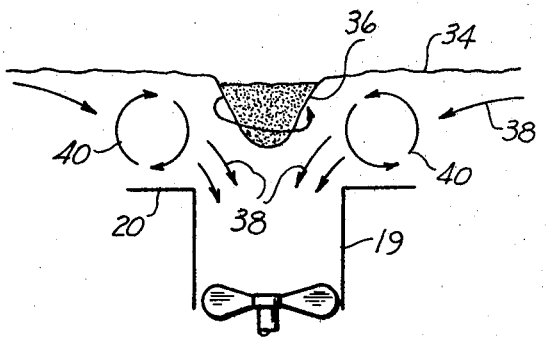
FIG. 5 illustrates the vortexing and skimming action of the mechanism shown in FIGS. 1-4.

FIG. 5 illustrates schematically the basic manner in which the mechanism of FIGS. 1 to 4 operates. The impeller is shown within duct 19 at the top of which is shown the flat horizontal surface of annular disc 20 which is made to rotate in the rotary direction of the vortex. It is not very important whether the duct 19 rotates as the rotary motion of the water above the annular disc 20 is imparted by the rotation of the disc 20. The annular disc is shown far enough below the surface 34 of the water so that substantially all of the resulting vortex wil be located above the duct 19. Thus, the pocket of floating material, such as oil, is above the line 36, well above the duct 19. The vortex containing this pocket of material to be collected is a free vortex as defined herein because it is not confined within any bounding walls such as the wall of a container or cylinder. The vortex which is formed is of a desirable form for the collection of floating material from a pocket, for it is not the undesirable long slender type, nor does it move outward and dissipate itself through its centrifugal force. The reason for this is that the rotary motion imparted to the liquid by the rotating annular disc 20 about the vertical axis of the duct forms eddy currents 40 of the liquid circulating in the direction of the arrows shown within lines 40 so that the outline of this circulating eddy current motion is in the form of a doughnut centered at the same vertical axis. This causes an axial flow down through the duct according to arrows 38 which represent the same flow as arrows 38 in FIG. 1. It is the rotational flow above the annular disc together with the axial flow down through the duct which forms the free vortex of the desirable shape and size which maintains itself even under adverse conditions of wind and waves and water currents. A vortex of this desirable character cannot be obtained by developing a vortex contained by container walls such as are shown in the Mourlon, et al. U.S. Pat. No. 3,635,342 because there would be no way of developing the important rotating water motion above the duct and outside the vortex in combination with the important axial flow also passing outside the vortex and then down into the duct. In the practice of the present invention, these particular water flows together with the attendant eddy currents will exist above the duct.

In perfectly calm water it is possible to form a free vortex by the use of the impeller alone, which as indicated above, will form a long, slender vortex containing oil. This however would not ordinarily be desirable for oil recovery, as such oil pocket as exists would be ill-defined and relatively elusive, and the proportion of oil to water recovered would not be great. The addition of the duct 19, particularly with its disc 20, even without the presence of the other parts disclosed herein, effectively establishes a definite oil pocket, permitting substantial oil recovery under proper conditions, such as absence or excessive speed of rotation, and sea conditions which are fairly favorable. The addition of the rotatable tubular element 22, of course, provides for maintenance of the oil pocket even under more unfavorable conditions, and the further addition of the stationary skirt and deflector further increase the efficiency of the recovery as described above.

Figure 7:
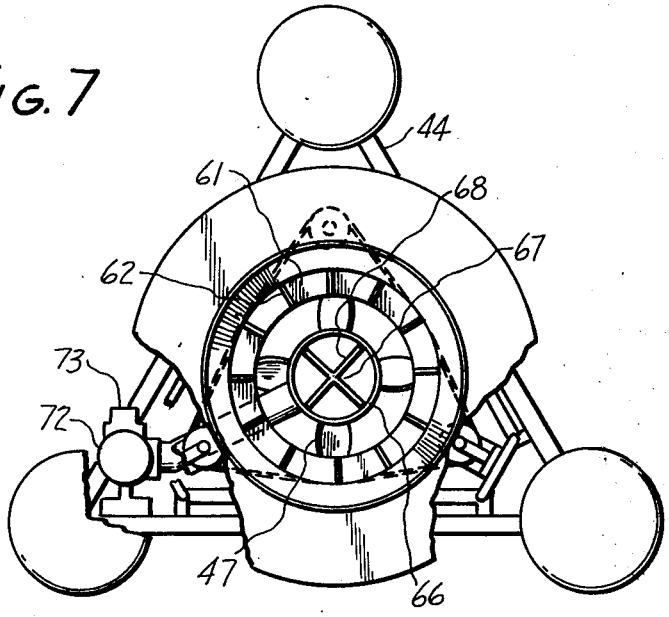
FIG. 7 is a top view of the mechanism of FIG. 6.
Figure 6:
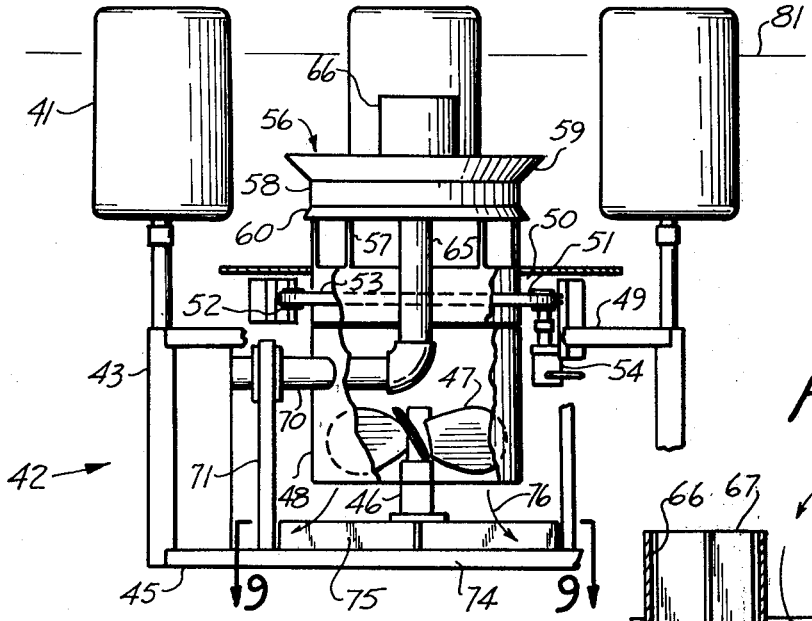
FIG. 6 is an elevation view, shown partly broken away, of another mechanism according to this invention.

FIGS. 6 and 7 illustrate another, and presently preferred, best mode embodiment of this invention. It comprises floats 41 attached to a frame 42 comprising uprights 43 and horizontal members 44, all joined in a manner somewhat similar to that of FIGS. 1 and 2, so that the horizontal members form the sides of a triangle. The central part of the triangle is traversed by a horizontal member 45 and a hydraulically operated motor 46 is supported centrally within the frame on member 45 so that the axis of rotation of the motor 46 extends vertically. An impeller 47 is attached to the vertical rotary shaft of the motor. A duct 48 in the form of a cylinder is mounted relative to the frame with its vertical axis co-lineal with that of the impeller so that the impeller is within the duct with enough clearance between the impeller blades and the duct to permit rotation of the impeller within the duct. The duct 48 may be suitably mounted for example, by arms 49 connecting it to frame members.

A short hollow cylindrical drive section 50 of the same diameter as fixed cylinder 48 is mounted above cylinder 48 it is rotatable and is adapted to be rotated by an endless belt 51 passed around pulleys 52 and fitted within a circmferential groove 53 around the drive section 50. The belt is driven by a motor 54, preferably of the hydraulic type, mounted to the main frame by structure 49 and driving one of the pulleys 52. The function of the rotatable duct section 50 is to support a rotatable tubular element 56 above it. The rotatable tubular element is held at some distance above the drive section 50 by a number of stilts 57 spaced around the periphery of drive section 50 and rotatable 56. The tubular element comprises a tube 58 having a frusto-conical upper rim 59 and a lower frusto-conical rim 60. Within the cylindrical portion 58 there is an annular shelf 61 from which there are a number of spaced upstanding vanes 62. Spaced somewhat below the annular shelf 61 there is a horizontal circular disc 63 of about the same diameter as that of cylinder 58 and having its periphery aligned with the periphery of cylinder 58 and leaving a flow passage 82 for water to leave the inside of the rotatable tubular element. The disc 63 is provided with a central hole 64 of the proper dimension so that a vertical pipe 65 passes closely through it. Disc 63 as well as annulus 61 are supported by the stilts 57. A hollow cylindrical section 66 of larger diameter than that of pipe 65 is mounted coaxially with pipe 65 on disc 63. The pipe 65 extends upwardly within the rotator to a position within cylinder 66 above disc 63. The upper end of pipe 65 is open and there is attached at its open end a pair of vanes 67 and 68 crossing each other at the longitudinal axis of the pipe and rotator. The upper edges of vanes 67 and 68 are at the same level as the upper edge of cylinder 66 which is above the upper peripheral edge of conical section 59. The lower end of pipe 65 has attached to it a horizontal length of pipe 70 which protrudes outwardly through the fixed duct and is supported by a suitable strut 71 mounted to the main frame and which leads to a suction pump 72 preferably of the hydraulic type which carries collected substance from within the vortex to a delivery pipe 73 which conveys it to a suitable receptacle.

In the operation of the embodiment of FIGS. 6 and 7 the impeller 47 is rotated within the fixed duct by its motor 46 and the motor 54 is operated to rotate the rotatable tubular element 56 and cylindrical 66 which thereby rotate relative to fixed pipe 65 and vanes 67 and 68. The impeller will draw the liquid down through the duct and the rotatable tubular element 56 will produce a rotational field in the water above it, the vanes 62 aiding in this rotational function. This action will form a vortex above the rotatable tubular element 56 and material to be collected such as oil will be drawn into the vortex forming a pocket as described in connection with FIG. 1. The top of cylindrical section 66 is set at the proper distance above the rotatable tubular element rotator relative to the vortex so that it enters the pocket of oil or other material, which is drawn down through cylindrical section 66 and into collector pipe 65 by the recovery pump 67, and thus collected. The action of vanes 67 and 68 is to reduce rotary motion of water occurring within cylindrical section 66 and cause the water to run down through the pipe 65 substantially vertically without undue turbulence.

Figure 9:
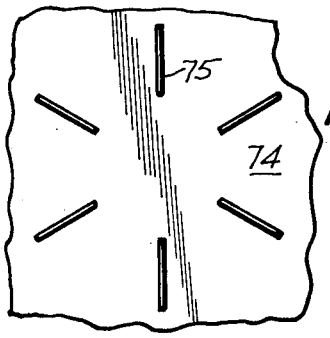
FIG. 9 is a view of a portion taken at line 9—9 of FIG. 6.

At the bottom of the frame there is mounted a horizontal plate 74 of a diameter somewhat greater than that of duct 48 and centered on the longitudinal axis of the impeller. This plate has a number of radially extending vanes 75 mounted to the plate in vertical planes as indicated in FIG. 9. The function of this plate 74 is to divert the water impelled downwardly through the duct which could have a tendency to drive the assembly upwardly to the surface of the water. By the presence of plate 74 with its radial vanes the water is diverted horizontally and radially in all directions as indicated by arrows 76. It is desirable that a similar plate be placed at the lower part of the frame beneath the impeller in the embodiment of FIGS. 1 and 2, for a similar reason.

Figure 10:
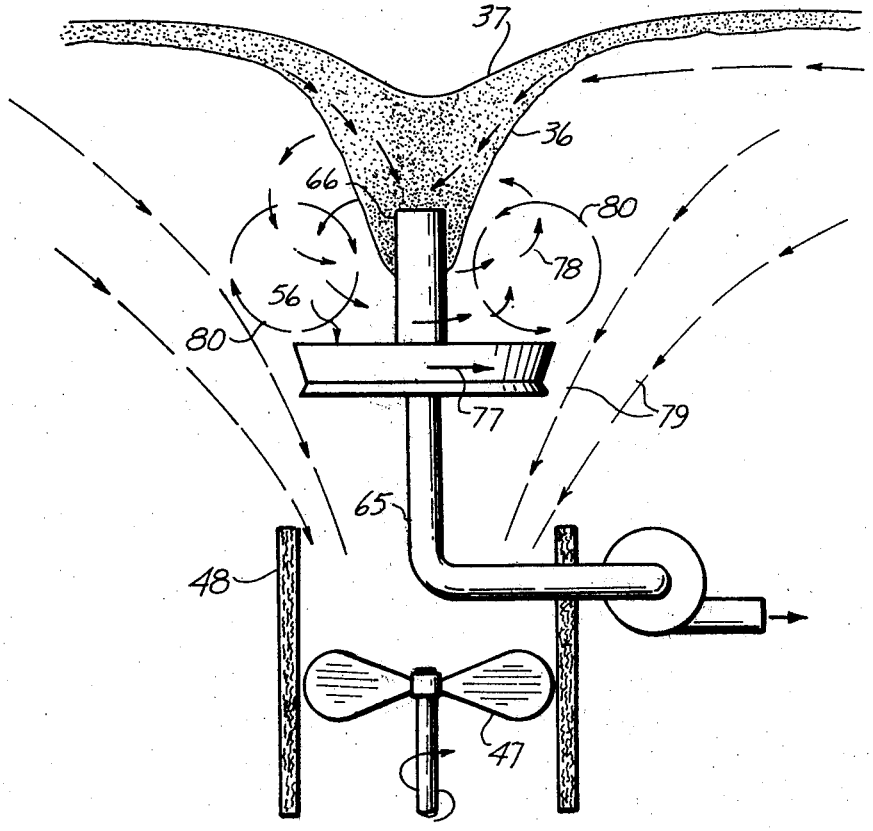
FIG. 10 illustrates schematically the vortexing and skimming action of the embodiment of FIGS. 6 and 7.

The action of the embodiment of FIGS. 6 and 7 is illustrated schematically in FIG. 10 which shows the basic elements which produce the action, namely the impeller 47 within the duct 48, the rotatable tubular element 56 above it beneath the surface of the water and the recovery conduit 65 with cylindrical section 66 protruding above the rotatable tubular element into a pocket of oil, or the like, bounded by lines 36 and 37.

Figure 8:
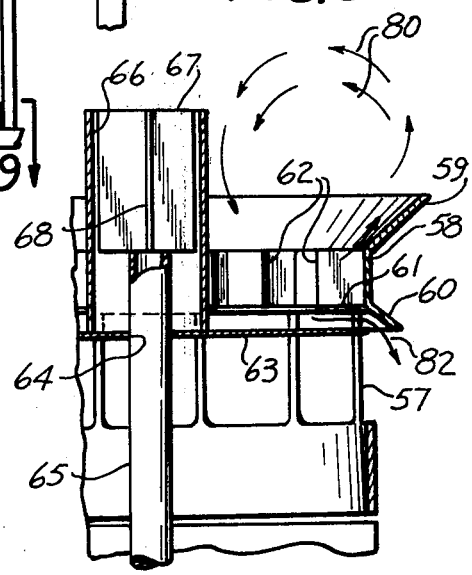
FIG. 8 is a partial view, partly in cross-section, of a portion of the structure of FIGS. 6 and 7 taken at line 8—8 of FIG. 7.

Rotation of the rotatable tubular element 56 in the direction of arrow 77 produces a rotational field in the water above the rotatable tubular element as presented by arrows 78. At the same time, the impeller is creating an axial flow field as represented by arrows 79 between the rotatable tubular element 56 and the duct 48. An eddy current field will also be set up as represented by arrows 80, this being similar to the eddy current field 40 in FIG. 5. This eddy current action is fostered by the vanes 62 on the rotatable tubular element which not only produce the rotational field, but also cause the eddy current action as indicated in FIG. 8. In this eddy current action relatively little water passes downward through the space between annular disc 61 and cylinder 66 as the vanes 62 catch most of the water in that area and throw it up again in the eddy current action. Such water as does pass down at this region flows out over shelf 63 as indicated by arrow 82 (FIG. 6). Axial flow passes both outside of and inside of this doughnut-shaped eddy current field and confines the rotational field to its position above the rotator and inhibits its spreading out.

Cylinder 22 is sometimes referred to herein as a "rotatable tubular element".

Disc 20 (an annulus) in FIG. 1, and rotator 56 in FIG. 6 are sometimes referred to as a "rotatable tubular element". Each of them is tubular, in the sense that it has a peripheral boundary, and each includes a flow passage means that permits flow of liquid into and out of the element so it enters and leaves the ring from axially spaced-apart locations. In FIG. 1 the fluid passage means is formed by the inside diameter of the annular disc 20, and the liquid flows through it from top to bottom. In FIGS. 6 and 8, the peripheral boundary is tube 58 with its upper and lower rims 59 and 60. The flow passage means is the center of the tube, extending from its upper end to and through passage 82. In both cases the liquid enters and departs the element from axially spaced-apart locations.

The term "tubular" is not limited to a body which is a body of revolution with all axial cross-sections uniform. For example, rotatable tubular element 56 in FIGS. 6 and 8 is a tubular ring body, but includes vanes 62, which render the axial cross-sections different from place to place. Neither does "tubular" mean that the center of the structure must be unoccluded. Plate 63 occludes the bottom of tube 58 in FIGS. 6 and 8, and exiting axial flow is sidewardly directed. Therefore the flow pattern is not limited to axial entry and axial exit. Attention is called to the fact that only some of the liquid that gets inside the ring-shaped body needs to flow through the ring shaped body. FIG. 6 shows some water departing at 82, but other water moves upwardly and outwardly as a consequence of impulsion of the vanes.

Also, the adjective "cylindrical" is used with "rotatable tubular element" herein. This term is more limited than "rotatable tubular element", because it requires that it include a portion which is circularly cylindrical. This does not, however, exclude a structue which has a cylindrical part but in addition carries something with it that renders the total cross-section something other than a pure circular cylinder. For example, element 56 in FIG. 6 carries vanes, but still is "cylindrical". Also, the term "cylindrical" does not require that there be no occlusion of the center opening. The vanes do somewhat occlude the center opening. Cylinder 22, and rotator 56 are both "cylindrical rotatable tubular elements".

Although dimensions of the mechanism of FIGS. 6 through 9 are not critical, it is noted that an embodiment has been made with a dimension of 5 feet between centers of adjacent floats 41 and with a dimension of 5½ feet from the top of the float to the bottom of member 74. The distance from the top of rotator 56, excluding the central cylinder 66, below the surface 81 of the water will be about 6 to 7 inches and the cylinder 66 will extend upward into the pocket of the vortex.

The operation of this device may aptly be summarized by reference to FIG. 10. Arrows 80 illustrate a generalized boundary of a ring-shaped region of liquid which is coaxial with and is disposed above rotational element 56 (sometimes called a "rotator member"). It is generally toroidal, and the eddy currents in it move radially outwardly at the bottom, then upward, then radially inward, and then axially downward, and again outward. The liquid in the ring-shaped region rotates as a generalized body around the axis. A particle trapped in the fluid of the region would theoretically take a generally curvilinear, hilical (sometimes spiral) path around the central, longitudinal axis. Of course, there will be an interchange of liquid, and transfer between the various flow paths, but the bodily rotation of the material in the region will tend to create the vortex inside it. In the meantime, the major porton of the flow of liquid downward to duct 48 passes by the outside of the region, and tends radially to confine the liquid in the said region.

The "twisting" or "eddy current" motion tends to draw a layer comprising liquid at the surface together with material on it toward the vortex. This movement is shown by the uppermost horizontal arrows in FIG. 10. Thus, the flow of liquid toward the duct divides at the ring-shaped region. The surface part flows to the vortex, and the deeper part flows to the duct (confining the ring-shaped region). Because of the resupply of liquid from the surface, some of the most central liquid will transfer to the ring-shaped region, and some of the latter will transfer to the downward flow.

It will be recognized that by the present invention there is provided a mechanism capable of harvesting and separating oil from water in one operation. Furthermore, the mechanism is capable of attracting oil from distances as great as 20 feet and more, from the vortex.

The device is effective to recover a broad range of oil film thicknesses from 0.001 inches and thicker. Moreover, recovery can be made of either liquid oil or solid oil-sorbent materials. The mechanism is capable of drawing in and collecting continuous sheets of liquid oil or patches of liquid oil as well as discrete, solid chunks of oil-sorbent material.

It will be understood that the embodiments of the invention illustrated and described herein are given by way of illustrtion and not of limitation, and that modifications or equivalents or alternatives within the scope of the invention may suggest themselves to those skilled in the art.

We claim:

1. Mechanism for removing material from a liquid surface comprising:

a cylindrical rotatable tubular element having a substantially upright axis of rotation and an axial dimension of length, and including flow passage means permitting flow of liquid into and out of the cylindrical rotatable tubular element entering and departing the cylindrical rotatable tubular element from axially spaced-apart locations;

a liquid flow duct having an open entrance end and an open exit end, and having an axis of flow;

means in said liquid flow duct between its entrance end and its exit and for causing liquid to flow through said flow duct from said entrance end to said exit end;

means for rotating the cylindrical rotatable tubular element;

means supporting the cylindrical rotatable tubular element and the flow duct relative to the surface of a body of liquid and to each other so that the cylindrical rotatable tubular element is positioned beneath the liquid surface and rotates around said axis, and at least a major portion of the flow duct is positioned beneath the elevation of the bottom of the cylindrical rotatable tubular element with the axis of flow at said entrance end coaxial with the axis of rotation of the cylindrical rotatable tubular element, and the means for causing liquid to flow through the flow duct constructed and arranged to move water downwardly into the entrance end, through the flow duct, and out the exit end, and the cylindrical rotatable tubular element constructed and arranged to rotate water around its said axis, whereby there is formed in the liquid above the cylindrical rotatable tubular element, a free vortex into which material on the liquid collects in a pocket; and means for extracting material from said pocket.

2. Mechanism according to claim 1 in which the flow duct is rotatably driven.

3. Mechanism according to claim 1 in which the means for drawing liquid through the flow duct comprises an impeller in the flow duct coaxial with the axis of the flow duct.

4. Mechanism according to claim 3 in which the flow duct is rotatably driven.

5. Mechanism according to claim 3 in which the means supporting the rotatable tubular element, the flow duct and the impeller relative to the surface of the body of liquid comprises a float means.

6. Mechanism according to claim 5 in which the flow duct is rotatably driven.

7. Mechanism according to claim 3 in which the rotatable tubular element includes a disc having a flat horizontal upper surface with an outer circumference outside the circumference of the duct.

8. Mechanism according to claim 1 in which the rotatable tubular element includes a disc having a flat horizontal upper surface with an outer circumference disposed outwardly from the circumference of the flow duct.

9. Mechanism according to claim 1 in which a skirt surrounds, and is spaced from, the flow duct.

10. Mechanism according to claim 9 in which the skirt is stationary and does not rotate.

11. Mechanism according to claim 10 in which a horizontal deflector plate is attached to an upper part of the skirt, the inner circumference of the deflector plate being disposed inwardly from the circumference of the skirt.

12. Mechanism according to claim 1 in which a funnel is attached to the upper end of the rotatable tubular element.

13. Mechanism according to claim 1 in which the means extracting the material comprises a conduit having an inlet above the rotatable tubular element, and means connected to the conduit for drawing material through the conduit.

14. Mechanism according to claim 1 in which the rotatable tubular element is provided with a closure adjacent to its bottom and opening means near the bottom and above the closure through which liquid may flow out of the rotatable tubular element.

15. Mechanism according to claim 14 in which a second impeller is mounted within said rotatable tubular element at the region of the opening means so that the rotation of said second impeller assists the flow of liquid from within the rotatable tubular element out through the opening means.

16. Mechanism according to claim 1 in which a material recovery pipe extends upwardly from a position beneath the rotatable element along the axis of rotation of the tubular element and terminates at a position above the rotatable tubular element.

17. The method of recovering material from a liquid surface which comprises:

rotating on a vertical axis a cylindrical tubular element placed beneath the surface of the liquid so that liquid above the element and surrounding the vertical axis is formed as a ring-shaped region which rotates bodily around said axis and is formed of eddy currents which flow in a generally curvilinear path radially outward from said axis, then axially upward, radially inward and axially downward;

drawing a downward axial flow of water through a duct having an upright axis substantially co-linear with the axis of said rotating element so that some of the axial flow of water envelops said rotational field, whereby a free vortex is formed in the liquid between the surface and the element, said vortex containing a pocket of said material drawn from the surface of the liquid; and extracting the material from said pocket.

18. The method according to claim 17 wherein the major portion of the axial flow of the liquid is passed downward outside the periphery of said element and caused to enter said duct through the region between the bottom of said element and the top of said duct.

19. The method according to claim 18 in which the surface layer of liquid is caused to pass through said ring-shaped region.

* * * * *